United States Patent [19]

Berger et al.

[11] Patent Number: 4,887,807

[45] Date of Patent: Dec. 19, 1989

[54] SIDE-LIMIT STOP FOR A DEVICE FOR SEPARATING OF PAPER PIECES FROM A STACK

[75] Inventors: Erwin Berger, Thörishaus; Christian Moy, Kriechenwil, both of Switzerland

[73] Assignee: Hasler AG, Bern, Switzerland

[21] Appl. No.: 162,297

[22] Filed: Dec. 24, 1987

[30] Foreign Application Priority Data

Apr. 24, 1986 [CH] Switzerland ..... 1669/86

[51] Int. Cl.[4] ..... B65H 1/00

[52] U.S. Cl. ..... 271/171; 414/900

[58] Field of Search ..... 271/171, 144, 223, 165, 271/145; 221/242; 414/900

[56] References Cited

U.S. PATENT DOCUMENTS

| | | | |
|---|---|---|---|
| 4,395,036 | 7/1983 | Bergman et al. | 271/171 |
| 4,436,469 | 3/1984 | Kelly | 271/171 X |
| 4,457,507 | 7/1984 | Ishikawa et al. | 271/171 X |
| 4,512,562 | 4/1985 | Moll | 271/171 X |
| 4,568,074 | 2/1986 | Murayoshi | 271/121 |

FOREIGN PATENT DOCUMENTS 2146626A 4/1985 United Kingdom .

OTHER PUBLICATIONS

IBM, Technical Disclosure Bulletin, vol. 25, No. 8, Jan. 1983, pp. 4322–4323, Rotary Reference Edge for Off--Set Stacking.

Hasler Mitteilungen, 37th vol., No. 1, Apr. 1978, Hasler AG, (Bern, Ch), R. Grunig: "Die Frankiermaschine Hasler Mailmaste".

*Primary Examiner*—Joseph J. Rolla
*Assistant Examiner*—Steven B. Parker
*Attorney, Agent, or Firm*—Horst M. Kasper

[57] ABSTRACT

The invention relates to the sidestop (20) guides, in the separating device (10), in particular a device for feeding a franking machine, the respective pile (11) of letters to be franked, irrespective of their particular format, by the front part of their longitudinal edge. The stop (20) comprises a support (25) with two stop surfaces (21, 22) arranged at right angles. The support can turn through 90° around a pin (29) in a counter-clockwise direction. Small envelopes are guided by one of the stop surfaces (21); larger ones are guided by the other stop surfaces (22) when the support (25) is rotated. The stop (20) can be moved perpendicularly to the direction of movement of the envelope and turned to a third working position in which it forms an additional stop surface for envelopes of very large dimensions.

19 Claims, 2 Drawing Sheets

SIDE-LIMIT STOP FOR A DEVICE FOR SEPARATING OF PAPER PIECES FROM A STACK

BACKGROUND OF THE INVENTION

1. Field of the Invention

The invention relates to a side-limit stop for a device for separating of paper pieces from a stack employing a side-limit stop of a feeding apparatus of a postage meter machine for any size letter envelopes.

2. Brief Description of the Background of the Invention Including Prior Art

A modular constructed postage meter machine is known from the Journal "Hasler Mitteilungen" 37, April, 1978) 1, 1–7. The letter feeding apparatus of this postage meter machine comprises, among others, a support table or feed table for placing or feeding of the letter envelopes to be furnished with postage, a feed wedge, a letter separator, a taking-in or feeder segment, a side guidewall, and a laterally movable side stop. This side stop is adjusted in each case such to the dimension of the envelope to be provided with postage such that these envelopes are not maintained too loosely between the guidewall and the side stop. This side stop is provided with a certain area, but it is so narrow that it hardly interferes with a refilling of envelope stacks from the side. The stop can be folded downwardly by an angle of 180 degrees for allowing postage metering of oversized envelopes.

The side-limit stop is supported via a movable U-shaped bent sheetmetal crosswise to the direction of motion of the letter envelope below the feed table. In order to be able to laterally guide all conventional envelope sizes, starting from about C7 to C3, the shifting path is so large that the slidable sheetmetal piece protrudes in case of a narrower or smaller setting of the side-limit stop on the back side of the letter feeding apparatus.

A franking machine Hasler Mailmaster F204 (Trademark) is taught in Hasler Review Vol. 11, issue no. 1, Pages 2 to 7. This reference refers to a general postage metering machine.

An envelope prop for use in a mailing machine is taught in British Patent application GB-2146,626A to Hans J. Sinn et al. The envelope prop is provided with a support allowing sliding in one direction.

U.S. Pat. No. 4,395,036 teaches a sheet feeder with stack-holding tray having flexible-band-coupled guide elements. The reference teaches to employ a flexible band formed in a loop, where the band element is attached to guide elements at two locations for providing a motion in unison of the guide elements. The use of more than one movable guide element would complicate a postage metering machine.

A rotary reference edge for off-set stacking is taught by C. A. Beehler and J.M. Hopping, in IBM Technical Disclosure Bulletin, Vol. 25, No. 8, January 1983. Operation of this rotary reference edge requires the presence of a solenoid.

Today, there exists a desire not only to insert letter envelopes with closed or folded-over closure flaps in stacks into the feed apparatus but, in addition, to be able to insert also envelopes which have a flap which is open at an angle of 90 degrees. This requires the presence of a groove or a slot between the feed table and the side guidewall for receiving of the opened flaps. Furthermore, this desire requires a shortening of the slidable piece of sheetmetal such that this not cross the groove of the letter envelope flaps. The shortening in turn has the consequence that a side-limit stop of the recited construction cannot be adjusted to all envelope sizes.

SUMMARY OF THE INVENTION

1. Purposes of the Invention

It is an object of the invention to provide a simple side-limit stop which allows a lateral guidance of envelopes of any size.

It is another object of the invention to provide a side-limit stop which is supported from below the feed table and which side-limit stop requires a smaller shifting clearance than corresponding conventional side-limit stops. It is a further object of the invention to provide a mechanism for adjustably controlling the positioning of envelopes of various sizes fed to a postage metering machine..

These and other objects and advantages of the present invention will become evident from the description which follows.

2. Brief Description of the Invention

The present invention provides an apparatus for separating of paper pieces from a stack of paper pieces. The apparatus comprises a feed table and a separator. Furthermore, a side-limit stop having two limit-stop surfaces is disposed in a plane about parallel to a feed table plane. A side guidewall, together with the side-limit stop, places the stack into position. The side-limit stop is supported crosswise to the separating direction of the paper pieces below the feed table in a slidable manner. The limit-stop surface of the side-limit stop can be folded away. A support bolt is horizontally slidably supported crosswise to the separating direction under the feed table. A support block is rotatably supported by the support bolt for turning around the axis of the support bolt. A pin is disposed at a support block and directed perpendicular to the support bolt. A carrier is rotatably supported around the pin. A first limit stop surface is disposed on the carrier for defining a placement space for envelopes on the feed table. A second limit-stop surface is disposed at an angle with respect to the first limit stop surface. Means limit the rotational motions around the axis of the support bolt and of the pin. Means fix the support block and the carrier in three predetermined positions, such that the support block is formed relative to the support bolt such, and the pin relative to the two limit-stop surfaces such, that, in a first position, the first limit-stop surface supports envelopes of smaller dimensions and, in the second position, the second limit-stop surface supports envelopes of larger dimensions, in each case, at the end of the front half of the longitudinal edge of the respective stack such that, in a first position, the carrier can be slid over the feed table, that, in a second position, the support block forms a support surface at an about equal level with the feed table and that, in a third position, the support block forms together with the second limit-stop surface an additional support surface at about the same level as the feed table.

The support bolt can be fixed against rotation and the support block can be supported rotatable around the support bolt.

The support block can be fixedly attached at a support bolt and the support bolt can be rotatably supported at the feed table.

The limit-stop surfaces can be disposed at a right angle relative to each other and can be inclined at an angle from about 1 to 20 degrees relative to the vertical. The means for limiting the rotational motions can be disposed such that the rotations, in each case, are limited to 90 degrees.

The means for fixing of the support block and of the carrier can be springs which engage springingly in coordinated recesses.

The support bolt and the pin can be disposed in on plane. The pin can be disposed eccentrically in a corner of the carrier.

The carrier and the support block can be formed as injection molded parts made of a plastic material.

The handle recesses of the apparatus can be disposed at the carrier.

Preferably, the pin is attached such that it can be moved to a distance from the feed table which is larger than a maximum lateral length of the second limit-stop surface.

A limit stop can maintain the carrier in an operating position.

In the following, the invention is described in more detail based on four figures by way of example. The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
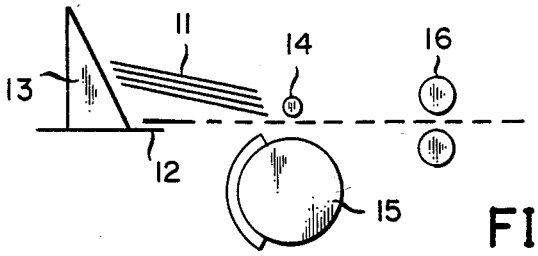
FIG. 1 is a schematic side view of a separating device for a postage metering machine.

In accordance with the present invention, there is provided a side-limit stop 20 for an apparatus for separating of paper pieces from a stack 11. The apparatus comprises at least one feed table 12, a separator 14, and a side guidewall 17 which, together with the side-limit stop 20, put the stack 11 into position. The side-limit stop 20 is supported crosswise to the separating direction of the paper pieces below the feed table 12 in a slidable manner. The limit-stop surface 21, 22 of the side-limit stop 20 can be folded away. A support bolt 34 is employed which is horizontally slidably supported crosswise to the separating direction under the feed table 12. A support block 32 is rotatably supported around the axis of the support bolt 34. A pin 29 is disposed at a support block 32 perpendicular to the support bolt 34. A carrier 25 with two limit-stop surfaces 21, 22 is disposed at an angle with respect to each other. The carrier is rotatably supported around the pin 29. A means limits the rotational motions around the axis of the support bolt 34 and around the pin 29. A means fixes the support blocks 32 and the carrier 25 in three predetermined positions, such that the support block 32 is formed relative to the support bolt 34 such, and the pin 29 relative to the two limit-stop surfaces 21, 22 such, that, in a first position (FIG. 2), the one limit-stop surface 21 supports envelopes of smaller dimensions such as, for example, C6, and, in the second position (FIG. 3), the second limit-stop surface 22 supports envelopes of larger dimensions such as, for example, C4, in each case at the end of the front half of the longitudinal edge of the respective stack 11. In a first position (FIG. 2), the carrier 25 can be slid over the feed table 12. In a second position (FIG. 3), the support block 32 forms a support surface at an about equal level with the feed table 12. In a third position (FIG. 4), the support block 32 forms together with the second limit-stop surface 22 an additional support surface at about the same level as the feed table 12.

The support bolt 34 can be fixed against rotation and the support block 32 can be supported rotatable around the support bolt 34.

Preferably, the support block 32 is fixedly attached at the support bolt 34 and the support bolt 34 is rotatably supported.

The limit-stop surfaces 21, 22 can be disposed at a right angle relative to each other and can be slightly inclined relative to the vertical. Preferably, the means for limiting the rotational motions are disposed such that the rotations, in each case, are limited to 90 degrees.

The means for fixing of the support block 32 and of the carrier 25 can be springs which engage springingly in coordinated recesses.

The support bolt 34 and the pin 29 can be disposed in one plane. The pin 29 can be disposed eccentrically in a corner of the carrier 25.

The carrier 25 and the support block 32 can be formed as injection molded parts made of a plastic material.

Handle recesses 26, 27 can be disposed at the carrier 25.

FIG. 1 illustrates, according to the recited reference, Hasler Mitteilungen, 37, April 1978 a schematic side view of a separating device 10, in particular of the feeding apparatus of a postage meter machine. A stack 11 of uniformly dimensioned letter envelopes is placed at an angle into the device 10. The envelopes are separated from below and are to be furnished with postage sequentially on their upper side. The stack 11 rests on a feed table 12 and is supported in the rear by a feed wedge 13 and, in the front, by a letter separator 14. A rotatable feeder segment 15 pulls in each case the lowermost envelope in forward direction (in FIG. 1 toward the right) and then guides this envelope via two transport rollers 16 toward further transport.

Figure 2:
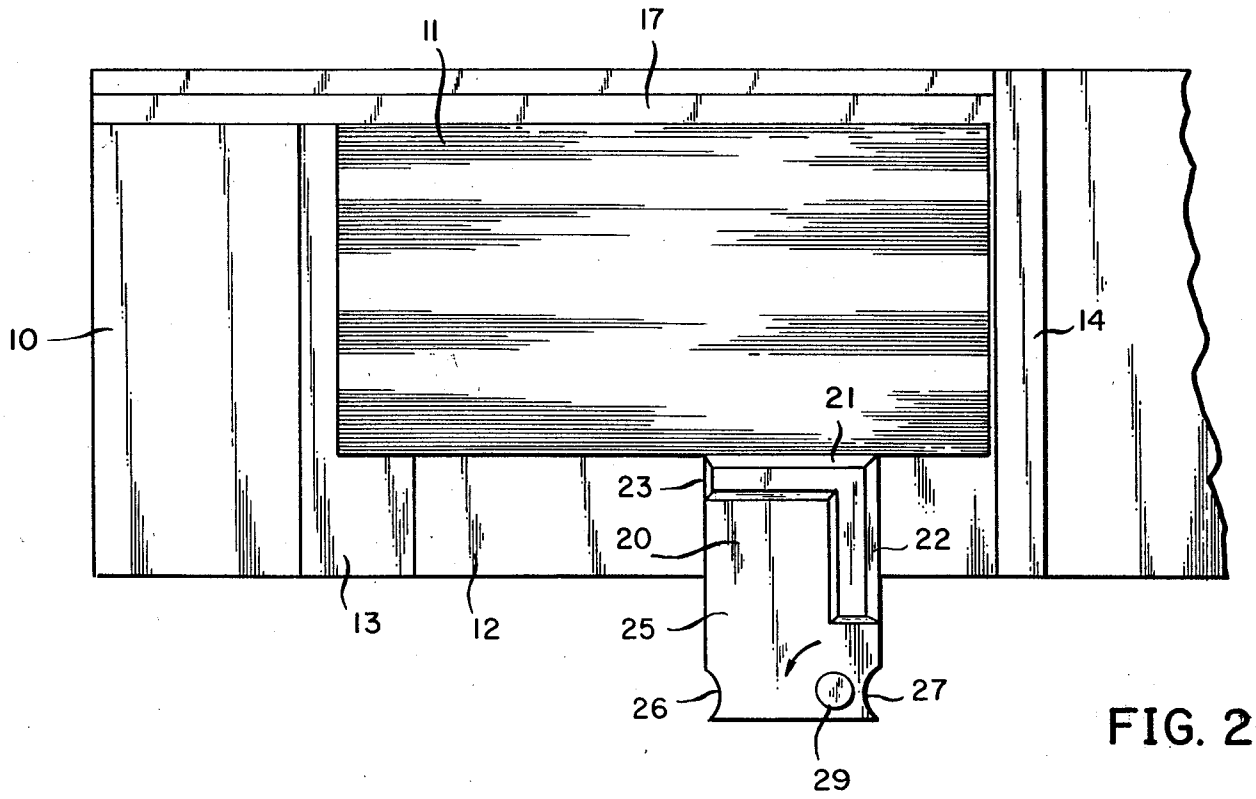
FIG. 2 is a partial plan view of the separating device of FIG. 1 including a first position of a side-limit stop according to the invention.

FIG. 2 illustrates the separating device 10 from above. A stack 11 of smaller-dimension letter envelopes is placed on the feed table 12, which smaller-dimension letter envelopes have for example the standard dimensions of C6. The stack 11 is maintained and supported, as described, in the rear and in the front by the feed wedge 13 or, respectively, the separator 14. On the side, the stack 11 is supported or, respectively, guided by a guide wall 17 and a side-limit stop 20. The side-limit stop 20 protrudes with a plate-shaped, about rectangular carrier 25 above the feed table 12. The carrier 25 carries at its front side a first planar limit-stop surface 21 and, sequentially following to this and disposed thereto at a right angle, a second limit-stop stop surface 22. Both limit-stop surfaces 21, 22 are slightly inclined versus the vertical, i.e. they form an angle with the vertical. The angle versus a vertical direction can be between about 1 and 20 degrees and is preferably between 2 and 15 degrees. This angle is preferably about 2 degrees in the lower region of the limit-stop surfaces and about 15 degrees in the upper region of the limit-stop surfaces. Overall, based on this, there results a small funnel effect which additionally positions the envelopes upon slidingly moving from about in a downward direction.

The carrier 25 is provided with two side handle recesses 26, 27 and can be tilted by 90 degrees around a vertically disposed pin 29, in a counter-clockwise direction. This pin 29 is disposed eccentrically in a corner of the carrier 25 and, in fact, in that corner which is disposed diagonally opposite to the free edge 23 of the first limit-stop surface 21.

A side-limit stop 20 with a first locked-in operating position is illustrated in FIG. 2. The limit-stop surface 21 guides, in the first operating position, the stack 11 of smaller letter envelopes at about the end of the front half of the longitudinal edge of the stack. The width of the envelopes can be adjusted in a conventional manner by sliding of the side-limit stop 20 crosswise to the direction of motion of the letter envelope.

Figure 3:
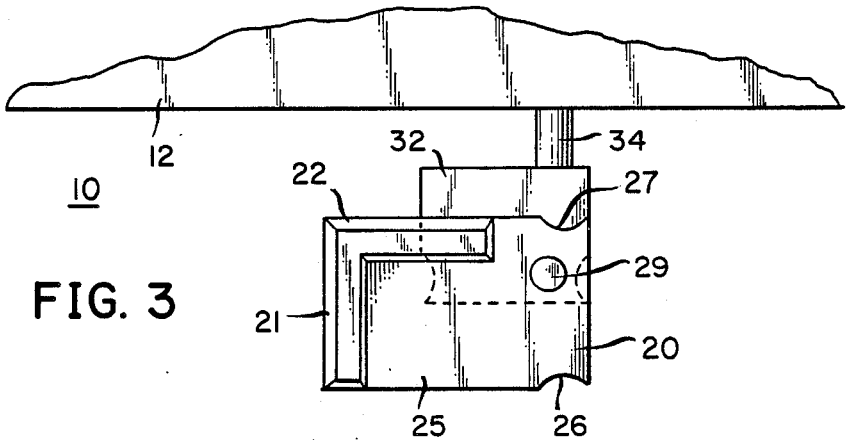
FIG. 3 is a plan view of the separating device of FIG. 1 similar to that of FIG. 2 with a second position of the side-limit stop.

FIG. 3 illustrates the separating device 10 with the side-limit stop 20 from above in a second operating position, which serves for guiding of larger-size letter envelopes, for example of the standard dimension of C4. This second operating position is obtained from the first position by rotation of the carrier 25 by 90 degrees around a pin 29 in a counter-clockwise direction. The carrier 25 releases in this position a previously covered support block 32. This support block 32 rests with its upwardly disposed surface at the same level as the feed table 12 and serves for supporting of envelopes of a larger size, which protrude beyond the feed table 12 in a lateral direction.

Since the pin 29 is disposed in a corner of the carrier 25, the then effective limit-stop surface 22 is shifted rearward opposite to the take-out direction of the envelopes in the second position. The limit-stop surface 22 guides the larger envelopes in a uniform manner, as did the limit-stop surface 21 for the smaller envelopes and, in fact, at about the end of the front half of its longitudinal edge.

FIG. 3 illustrates additionally a guide and support bolt 34 which supports the support block 32 of the side-limit stop 20. This bolt 34 can be shifted, however, it is fixed against rotation and supported under the feed table 12.

Figure 4:
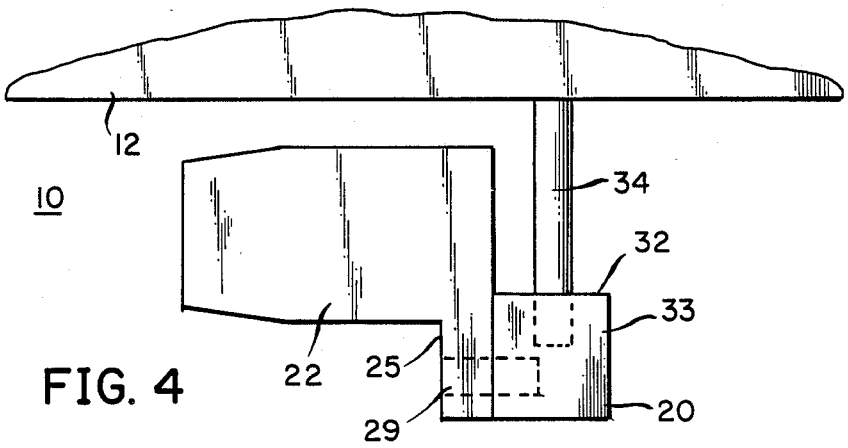
FIG. 4 is a plan view of the separating device of FIG. 1 similar to the view of FIG. 2 with a third flapped down position of the side-limit stop.

FIG. 4 is third plan view onto the separating device 10 and the side-limit stop 20 in a third operating position. The side-limit stop 20 is rotated thereby by 90 degrees in a counter-clockwise direction around the support bolt 34 starting at a first operating position.

The side surface 33 of the support block 32, which is thereby placed in a top position, and the limit-stop surface 22 form, according to a third operating position, a further support face, in particular for oversized envelopes, whereby, however, no side guide is provided any more. The pin 29, covered in this position, is illustrated by a dash line.

The engaging in the three positions can be effected, for example, by way of springs, which springingly engage corresponding recesses. In addition, limit-stop surfaces or, respectively, stop cams can be provided, which prevent a rotation in an undesired direction or, for example, beyond more than 90 degrees.

The side-limit stop 20 can advantageously be produced by injection molding of a plastic material. It is advantageous in this context, based on the requirements of the injection molding technique and of the problem of material saving, if the carrier 25 and the support block 32 are formed such that they provide hollow bodies which are open to the lower side.

The side-limit stop 20 of the described embodiment is simple in construction, safe in handling, and fulfills the initially mentioned requirements in an optimal way.

The separating device 10 in general serves for isolating and singling of planar paper pieces, i.e. of envelopes, of postcards, and other post office materials. It can be employed as desired, not only in connection with postage meter machines, but also in case of envelope machines, of folder machines, and the like.

The limit-stop surfaces 21 and 22 do not have to be disposed necessarily under a right angle but, in addition, they can also form any arbitrary other angle. The geometry between the limit-stop surfaces 21, 22, and the position of the pin 29, however, has to be furnished such that the limit-stop surface 21 for the smaller-size envelopes and the limit-stop surface 22 for the larger-size envelopes, in each case, rests at the stack 11 ahead of the middle of the longitudinal side of the respective envelope, however, not to far ahead.

The distance of the limit-stop surface 22 from the pin 29 is preferably 0.05 to 0.2 times the width of a smaller size prevailing envelope cross dimension. The distance of the limit-stop surface 21 from the pin 29 is preferably 0.5 to 1 times the with of a smaller size prevailing envelope and more preferably from abour 0.06 to 0.8 times the width of a smaller size prevailing envelope. The minimum distance between pin 29 and support bolt 34 is preferably less than one tenth of the distance of the limit-stop surface 21 from the pin 29 and preferably less than one fiftieth of the distance of the limit-stop surface 21 from the pin 29. The distance between the support bolt 34 and the top of the feed table 12 is preferably less than the distance between the pin 29 and the side of the side-limit stop 20 disposed opposite to the limit-stop surface 22.

The shaft of the pin 29 and of the support bolt 34 can be from about 0.1 to 0.25 times the distance of the limit-stop surfaces 21 from the axis of pin 29 and is preferably from about 0.15 to 0.20 times the distance of the limit-stop surface 21 from the axis of pin 29.

The support block 32 can be attached instead of rotatably also fixedly at the guide and support bolt 34. In this case, the bolt 34 has to be supported rotatably under the feed table 12.

Instead of the handle recesses 26, 27 disposed on the side, there can also be provided handle recesses at other ergonomically advantageous positions of the side-limit stop 20, for example, at the upper side of the carrier 25 and/or at the lower side of the support block 32.

It will be understood that each of the elements described above, or two or more together, may also find a useful application in other types of limit-stop system configurations and envelope handling procedures differing from the types described above.

While the invention has been illustrated and described as embodied in the context of a side-limit stop for a postage metering machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An apparatus for separating of paper pieces from a stack of paper pieces comprising a flat feed table for carrying said stack, which table determines a horizontal plane;

a vertical side guidewall on a rear side of said feed table, a side-limit stop on a front side of said feed table opposite to the rear side, said side-limit stop and said guidewall together bounding said stack, said side-limit stop comprising a support bolt horizontally slidably supported beneath the feed table in the direction from the said rear side to the said front side;

a support block mounted at one end of said a support bolt rotatably around the axis of the bolt;

a pin supported on said support block directed perpendicular to the direction of said support bolt;

a carrier supported on said pin and comprising a first limit stop surface on a first side and a second limit stop surface on a second side; such that between said carrier and said feed table there are possible three different predetermined positions, at the first of said three positions said carrier is placed above said feed table and said first limit stop surface lies parallel to said side guidewall;

at the second of said three positions said carrier is placed beside said feed table and said second limit stop surface lies parallel to said side guidewall and a wall of said support block flushes with said horizontal plane of said feed table; and at the third of said three positions said carrier is placed beside said feed table and said second limit stop surface flushes with said horizontal plane of said feed table.

2. The apparatus according to claim 1, wherein said support bolt is supported non-rotatably and said support block is mounted rotatably around said support bolt.

3. The apparatus according to claim 1, wherein said support bolt is supported rotatably and said support block is mounted fixedly at said support bolt.

4. The apparatus according to claim 1, wherein said first limit stop surface and said second limit stop surface are disposed at a right angle relative to each other; and wherein said pin and said support bolt are disposed in a joint plane.

5. The apparatus according to claim 1, wherein said pin is disposed eccentrically in a corner of said support block; and wherein said carrier is supported eccentrically on said pin.

6. The apparatus according to claim 1, wherein said carrier and said support block are formed as injection molded parts made of a plastic material.

7. The apparatus according to claim further comprising handle recesses disposed at said carrier.

8. The apparatus according to claim 1 further comprising fixing means for fixing said support block and said carrier in each of said three positions.

9. An apparatus for separating of paper pieces from a stack of paper pieces comprising a feed table having a horizontal plane;

a separator for moving paper pieces from said feed table; a side-limit stop having a first limit stop surface and a second limit stop surface, said side-limit stop having a first predetermined position, a second predetermined position and a third predetermined position relative to the feed table plane and being mounted adjacent one side of the feed table;

a side guidewall mounted on a side of the feed table opposite to the side of the side-limit stop, side wall together with the side-limit stop maintaining the stack in a predetermined position, wherein the side-limit stop comprises a support block mounted on a support bolt connected to the side of said table and movable in a first direction toward and away from the feed table at selected positions and pivotable around the axis of the bolt;—a pin supported on a side of the support block and directed perpendicular to said support bolt;

a carrier rotatably supported by said pin; said first limit stop surface being positioned on one side of said carrier; and said second limit-stop surface being positioned on a second side of said carrier;

means for limiting the rotational motions around the axis of the support bolt;

means for limiting the rotational motions around the axis of the pin;

means for fixing the support block and the carrier in the first predetermined position, in the second predetermined position and in the third predetermined position, such that the support block is positioned relative to the support bolt, and the pin is positioned relative to the two limit-stop surfaces, such that in the first predetermined position the first limit-stop surface supports envelopes of smaller dimensions and in the second predetermined position the second limit-stop surface supports envelopes of larger dimensions, in each of the first and second predetermined positions at the end of the front half of the longitudinal edge of the stack, such that in the first predetermined position the carrier can be slid over the feed table, and in the second predetermined position the support block forms a support surface at an about equal level with the feed table, and in the third predetermined position the support block forms together with the second limit-stop surface an additional support surface at about the same level as the feed table.

10. The apparatus according to claim 9 wherein the support bolt is fixed against rotation and the support block is supported rotatable around the support bolt.

11. The apparatus according to claim 9 wherein the support block is fixedly attached at a support bolt and wherein the support bolt is rotatably supported at the feed table.

12. The apparatus according to claim 9 wherein the limit-stop surfaces are disposed at a right angle relative to each other and are inclined at an angle from about 1 to 20 degrees relative to the vertical when in the first and second positions; wherein the means for limiting the rotational motions are disposed such that the rotations, in each case, are limited to 90 degrees.

13. The apparatus according to claim 9 wherein the support bolt and the pin are disposed in one plane.

14. The apparatus according to claim 9 wherein the pin is disposed eccentrically in a corner of the carrier.

15. The apparatus according to claim 9 wherein the carrier and the support block are formed as injection molded parts made of a plastic material.

16. The apparatus according to claim 9 further comprising handle recesses disposed at the carrier 17. The apparatus according to claim 9 wherein the pin is attached such that it can move to a position relative to the feed table which has a distance from the feed table, which distance is larger than a horizontal length of the second limit-stop surface.

18. An apparatus for separating of paper pieces from a stack (11), where the apparatus comprises at least one feed table (12) having a horizontal plane, a separator (14) for moving paper pieces from said feed table, and a side guidewall (17) mounted on a side of the feed table, which side guide wall, together with a side-limit stop (20) place the stack (11) into position, where the side-limit stop has a first predetermined position, a second predetermined position and a third predetermined position relative to the feed table plane and is mounted adjacent to one side of the feed table plane opposite to said side guide wall wherein the side limit stop comprises:

a support bolt (34) which is horizontally slidably supported crosswise to the separating direction under the feed table (12), a support block (32) rotatably supported around the axis of the support bolt (34) and movable in a first direction toward and away from the feed table at selected positions and pivotable about an axis of said support bolt (34), a pin (29) disposed on the support block (32) perpendicular to the support bolt (34), a carrier, rotatably supported around the pin (25) with first and second limit-stop surfaces (21, 22) which are disposed at an angle with respect to each other, means for limiting the rotational motions around the axis of the support bolt (34) and around the pin (29), and means for fixing the support block (32) and the carrier (25) in said first predetermined position, in said second predetermined position, and in said third predetermined position, such that in the first predetermined position (FIG. 2), the first limit-stop surface (21) supports envelopes of smaller dimensions and, in the second predetermined position (FIG. 3), the second limit-stop surface (22) supports envelopes of larger dimensions in each of the first and second predetermined positions at the end of the front half of the longitudinal edge of the stack (11), and such that in the first predetermined position (FIG. 2), the carrier (25) can be slid over the feed table (12), that, in the second predetermined position (FIG. 3), the support block (32) forms a support surface at an about equal level with the feed table (12), and that, in the third predetermined position (FIG. 4), the support block (32) is positioned together with the second limit-stop surface (22) for furnishing an additional support surface at about the same level as the feed table (12).

19. An apparatus for separating envelopes of different dimensions from a stack, comprising a feed table having a horizontal plane;

a separator for moving paper pieces from said feed table;

a side guidewall;

a side-limit stop, which, together with the side guidewall places the stack into a position on said feed table, wherein the side-limit stop comprises: a support block, a carrier, a support bolt and a pin axle, wherein the support bolt is horizontally slidably supported in a bearing below the feed table in a direction toward and away from said feed table, and wherein the support block is rotatably supported around the axis of the support bolt, wherein the pin axle is disposed on the support block perpendicular to the support bolt, wherein the carrier is rotatable around the pin axle, wherein the carrier carries first and second limit stop surfaces disposed at a 90 degree angle to each other, wherein the side-limit stop is fixable in three predetermined positions, wherein the first position is such, that the first limit-stop surface places a stack of smaller size envelopes while the carrier is positioned above the feed table, wherein the second position is such, that the second limit-stop surface places a stack of larger size envelopes while the support block forms a further table support plane additional to the feed table, and wherein the third position is such, that the first limit-stop surface is disposed below the plane of the feed table while the support block and the second limit-stop surface defines a second support plane additional to the support plane furnished by the feed table.

* * * * *